US010954776B2

(12) United States Patent
Hrupp et al.

(10) Patent No.: US 10,954,776 B2
(45) Date of Patent: Mar. 23, 2021

(54) MECHANICAL CASING PERFORATION LOCATOR AND METHODS OF USING SAME

(71) Applicant: Exacta-Frac Energy Services, Inc., Conroe, TX (US)

(72) Inventors: Joze John Hrupp, Montgomery, TX (US); Lloyd Murray Dallas, Streetman, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 30 days.

(21) Appl. No.: 16/423,534

(22) Filed: May 28, 2019

(65) Prior Publication Data

US 2020/0378241 A1 Dec. 3, 2020

(51) Int. Cl.

| | |
|---|---|
| ***E21B 47/09*** | (2012.01) |
| ***E21B 47/06*** | (2012.01) |
| ***E21B 43/11*** | (2006.01) |
| ***E21B 43/25*** | (2006.01) |
| *E21B 33/12* | (2006.01) |

(52) U.S. Cl.

CPC ..... *E21B 47/09* (2013.01); *E21B 43/11* (2013.01); *E21B 43/25* (2013.01); *E21B 47/06* (2013.01); *E21B 33/12* (2013.01)

(58) Field of Classification Search

CPC ..... E21B 47/09; E21B 43/11; E21B 43/25; E21B 47/06; E21B 33/12

See application file for complete search history.

(56) References Cited

U.S. PATENT DOCUMENTS

| | | | | |
|---|---|---|---|---|
| 2,947,520 | A | 8/1960 | Tappmeyer | |
| 4,212,207 | A | 7/1980 | Conradi | |
| 4,525,815 | A | 6/1985 | Watson | |
| 6,009,947 | A * | 1/2000 | Wilson | E21B 43/11 166/100 |
| 7,475,729 | B2 * | 1/2009 | Johnson | B09B 1/008 166/305.1 |
| 7,784,339 | B2 | 8/2010 | Cook et al. | |
| 8,079,415 | B2 | 12/2011 | Cook | |
| 8,079,416 | B2 * | 12/2011 | Parker | E21B 43/11 166/285 |
| 8,365,827 | B2 * | 2/2013 | O'Connell | E21B 43/119 166/308.1 |
| 8,752,622 | B2 | 6/2014 | Atherton et al. | |
| 9,033,046 | B2 * | 5/2015 | Andrew | E21B 43/26 166/308.1 |
| 2005/0194143 | A1 * | 9/2005 | Xu | E21B 33/13 166/285 |
| 2005/0284633 | A1 * | 12/2005 | Richard | E21B 7/20 166/278 |
| 2011/0094734 | A1 | 4/2011 | Atherton et al. | |
| 2015/0041135 | A1 * | 2/2015 | Coffey | E21B 43/11852 166/297 |

* cited by examiner

*Primary Examiner* — Yong-Suk (Philip) Ro

(74) *Attorney, Agent, or Firm* — J. Bennett Mullinax, LLC

(57) ABSTRACT

A mechanical perforation locator has a plurality of perforation locator pins that are normally urged to a run-in condition. Fluid pumped into a work string energizes the perforation locator and urges the perforation locator pins outwardly. When the mechanical perforation locator is pulled or pushed through a cased well bore using the work string, some of the pins are forced into perforations in the casing, which impedes movement of the perforation locator and produces a characteristic spike in work string weight that is detectable at the surface.

20 Claims, 14 Drawing Sheets

MECHANICAL CASING PERFORATION LOCATOR AND METHODS OF USING SAME

CROSS REFERENCE TO RELATED APPLICATIONS

This is the first application filed for this invention.

FIELD OF THE INVENTION

This invention relates in general to precision fracking systems and, in particular, to a novel mechanical casing perforation locator and methods of using same to facilitate precision fracking during cased well completion, cased well workover, and cased well re-completion.

BACKGROUND OF THE INVENTION

Logging cased well bores to determine casing condition and/or locate casing perforations is well known. Such logging is normally done using a cased-hole caliper, a flux-leakage tool, an electromagnetic phase-shift tool or an ultrasonic tool suspended on a wireline or a slickline that is run into the cased well bore. Such tools are known to produce an accurate casing perforation map. However, while such maps are useful for many purposes when it comes to relocating casing perforations for the purpose of completing, re-completing or reworking a cased wellbore dead reckoning is required and any casing perforation map is substantially useless in a long lateral wellbore.

It is also well known that at this time the most widely practiced form of well completion is a process known as "plug-and-perf". This involves running in a casing perforation gun string with a wireline, and "shooting" a sequence of spaced-apart casing perforation clusters. After the perforation guns are all spent, the spent guns are pulled out of the well and well stimulation fluid is pumped down the annulus to stimulate a production zone behind the respective perforation clusters just shot. A drillable plug is then run in with the wireline and set uphole from the last of the perforation clusters, and the process is repeated. In some instances, the drillable plug is run in on the same wireline as a next string of perforation guns. Plug-and-perf completion has several disadvantages. First, to save time a plurality of perforation clusters are generally shot in a single run, so well stimulation is not "focused", i.e. performed a cluster at a time to ensure that each cluster is properly stimulated. Second, since many perforation clusters are stimulated at once, a great deal of pump horsepower is required. This necessitates many expensive pump trucks on site. Furthermore, all of those pump trucks have to sit idle while wireline operations are being performed and that adds a great deal to the total expense of the well completion.

It is also known to complete short lateral well bores by perforating the entire bore at predetermined spaced intervals, and then running in with a straddle packer on coil tubing that is positioned using dead reckoning to theoretically straddle each of the respective perforations and perform focused tracking. While this has been practiced with some success in short laterals, it cannot be successfully practiced in the very long laterals commonly drilled today because coil tubing doesn't have enough reach, and the accuracy of dead reckoning decreases as well bore length increases due to many uncontrollable factors that are well understood in the art.

There therefore exists a need for a novel mechanical casing perforation locator and methods of using same that facilitate well completion, re-completion and workover.

SUMMARY OF THE INVENTION

It is therefore an object of the invention to provide a mechanical casing perforation locator and methods of using same that facilitate well completion, re-completion and workover.

The invention therefore provides a perforation locator comprising a cylindrical body having a first connector end and a second connector end, a central passage that extends from the first connector end to the second connector end, and a plurality of piston assemblies having perforation locator pins that are movable, in response to fluid pressure in the central passage, from a run-in condition in which the perforation locator pins do not extend beyond a periphery of the cylindrical body to a perforation locator condition in which the perforation locator pins are extended beyond a periphery of the cylindrical body and urged to enter a perforation in a cased well bore when a one of the perforation locator pins passes over the perforation.

The invention further provides a method of locating casing perforations in a cased well bore, comprising: connecting a mechanical perforation locator to a work string and running the mechanical perforation locator into a cased well bore that contains at least one casing perforation cluster; pumping pressurized fluid into the work string to energize the mechanical perforation locator and place it in a perforation locator condition; and moving the mechanical perforation locator in the perforation locator condition through the cased well bore until at least one perforation location pin of the mechanical perforation locator is urged into at least one perforation in the at least one perforation cluster and a work string weight indicator associated with the work string indicates, a characteristic spike in a string weight of the work string, indicating a casing perforation has been located.

The invention yet further provides a method of performing a workover of a cased well bore, comprising: connecting a tool string that includes a straddle packer, a collar locator and a mechanical perforation locator to a work string and running the tool string into a cased well bore that contains at least one casing perforation cluster; pumping pressurized fluid into the work string to energize the mechanical perforation locator and place it in a perforation locator condition; moving the mechanical perforation locator in the perforation locator condition through the cased well bore until at least one perforation location pin of the mechanical perforation locator is urged into at least one perforation in the at least one perforation cluster and a work string weight indicator associated with the work string indicates a characteristic spike in a string weight of the work string, indicating a casing perforation has been located; releasing the pressurized fluid from the work string and relocating the tool string to straddle the located casing perforation with the straddle packer; packing-off packers of the straddle packer to pressure isolate the casing perforation from the cased well bore; and pumping stimulation fluid down the work string to re-stimulate a production zone behind the pressure-isolated perforation.

The invention still further provides a method of re-completing a cased well bore, comprising: connecting a tool string that includes a straddle packer, a collar locator, a mechanical perforation locator and a casing perforator to a work string and running the tool string into a cased well bore that contains at least one casing perforation cluster; pumping pressurized fluid into the work string to energize the mechanical perforation locator and place it in a perforation locator condition; moving the mechanical perforation locator in the perforation locator condition through the cased well bore until at least one perforation location pin of the mechanical perforation locator is urged into at least one perforation in the at least one perforation cluster and a work string weight indicator associated with the work string indicates a characteristic spike in a string weight of the work string, indicating a casing perforation has been located; releasing the pressurized fluid from the work string and relocating the tool string so that the casing perforator is at a new location for a casing perforation cluster in the well bore located a prescribed distance from the located perforation; operating the casing perforator to create the new casing perforation cluster; relocating the tool string to straddle the newly created perforation cluster with the straddle packer; packing-off packers of the straddle packer to pressure isolate the new casing perforation cluster from the cased well bore; and pumping stimulation fluid down the work string to stimulate a production zone behind the pressure-isolated new casing perforation cluster.

The invention also provides a method of completing a cased well bore, comprising: perforating an entire length of the cased well bore to be put into production; connecting a tool string that includes a straddle packer, a collar locator, and a mechanical perforation locator to a work string and running the tool string into the perforated cased well bore until a toe of the cased well bore is reached; pumping pressurized fluid into the work string to energize the mechanical perforation locator and place it in a perforation locator condition; pulling the mechanical perforation locator in the perforation locator condition up through the cased well bore until at least one perforation locator pin of the mechanical perforation locator is urged into at least one perforation in the at least one perforation cluster in the cased well bore, and a work string weight indicator associated with the work string indicates a characteristic spike in a string weight of the work string, indicating a casing perforation has been located; releasing the pressurized fluid from the work string and relocating the tool string so that the straddle packer straddles the located perforation; packing-off packers of the straddle packer to pressure isolate the casing perforation from the cased well bore; pumping stimulation fluid down the work string to stimulate a production zone behind the pressure-isolated casing perforation; and repeating the steps of energizing the perforation locator, pulling the perforation locator, releasing fluid pressure in the perforation locator, packing-off the straddle packer packers and pumping stimulation fluid until all of the located perforations in the cased well bore have been stimulated.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1A:
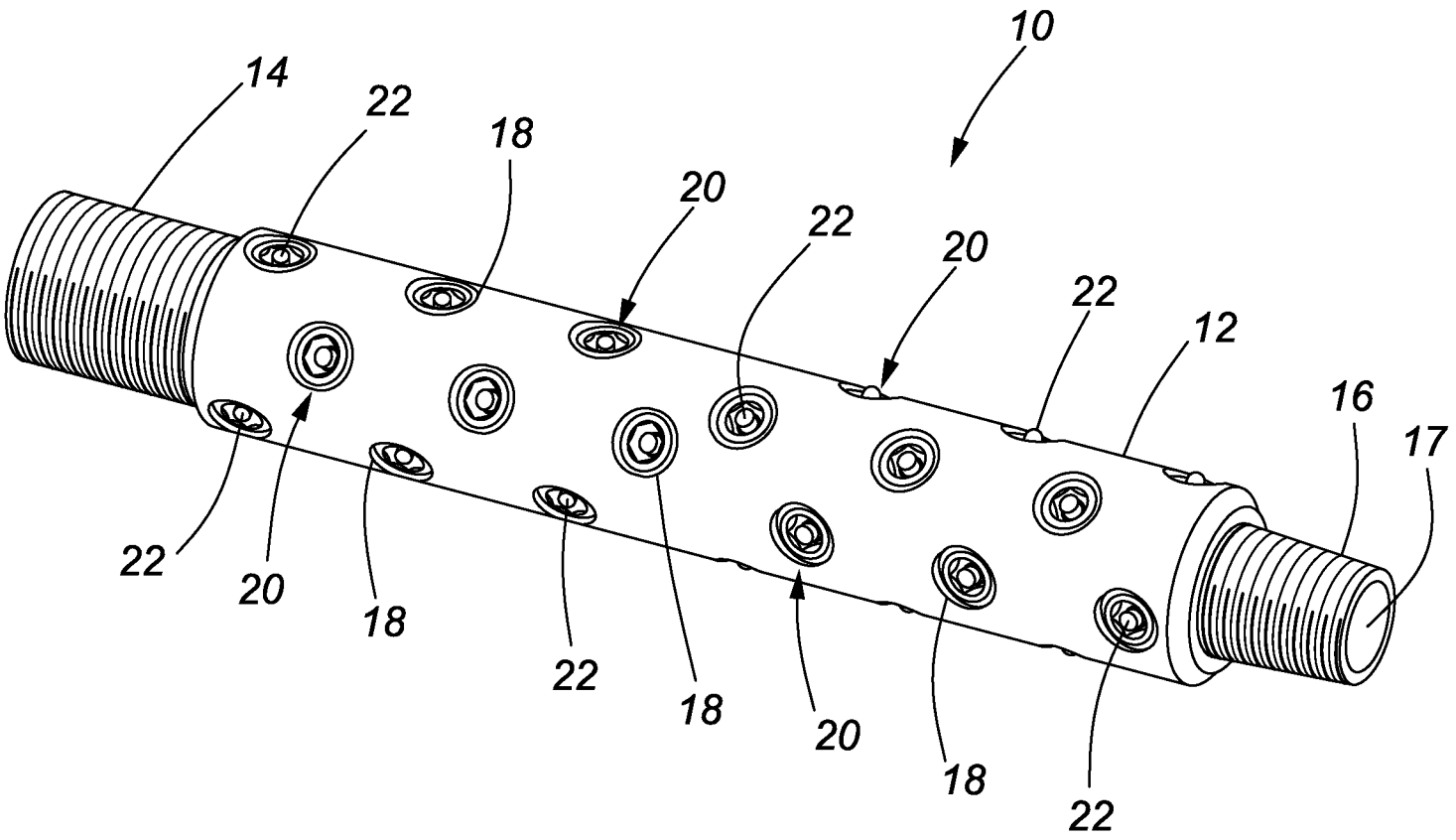
FIG. 1A is a perspective view of an embodiment of a mechanical perforation locator in accordance with the invention in a condition for running into a perforated well bore.

The invention provides cased well bore mechanical perforation locators (hereinafter, simply a perforation locators) and methods of using same in cased well completion, cased well re-completion, and cased well workover.

As used in this document, cased well completion means the preparation for production of any drilled, cased and cemented well bore that penetrates a subterranean hydrocarbon production zone, in particular any such deviated or lateral well bore. As used in this document, cased well re-completion means the rework of any completed cased well bore in which production has ceased or become economically unviable, such rework including, but not limited to, the addition of new perforations in the existing casing. As used in this document, cased well workover means the re-stimulation of a production zone behind existing perforations in a cased well bore in which production has ceased or become economically unviable.

The perforation locator is a cylindrical body carried in a tool string with other well completion, re-completion or workover downhole tools connected to a well completion, re-completion or workover tubing string, such as a coil tubing string for short bores or a jointed tubing string, which can be used in a well bore of any length. The perforation locator has a plurality of radial bores that receive piston assemblies. The respective piston assemblies include locator pins that move with locator pin pistons to a perforation location condition in response to fluid pressure pumped from the surface through the work string. In the perforation location condition, the locator pins are constantly urged against an inner periphery of the well casing. When the perforation locator is pulled or pushed past a casing perforation cluster in the perforation location condition, one of more of the locator pins is urged outwardly into a respective casing perforation until the locator pin piston reaches a travel limit. When the locator pin(s) engage the casing perforation(s), movement of the tool string within the well casing is impeded. This is readily detected by a work string operator who sees a characteristic string weight spike on a string weight gauge, which indicates that a perforation cluster has been located in the cased well bore.

Once a perforation cluster has been located, the operator can take appropriate action based on a current agenda for the well. If the well is being, worked over, the operator, who knows an exact relationship between the perforation locator and a straddle packer in the tool string, may manipulate the work string to straddle the located perforation(s) with the straddle packer so the perforation(s) can be re-fractured by pumping fracturing fluid down the work string. If the well is, being completed, the operator may manipulate the work string to straddle the perforation cluster and set the straddle packers so the cluster can be fractured by pumping fracturing fluid down the work string. Or, if the well is being re-completed the operator may manipulate the work string to move a specified offset from the located perforation(s) in order to create a new perforation cluster using a tubing perforator in the tool string, then re-position to straddle the newly created perforations before setting the straddle packers and fracturing the new perforation cluster.

In one embodiment the perforation locator includes an energizing sub used when proppant-laden fracturing fluid is employed to stimulate a production formation surrounding the cased well bore. The energizing sub isolates the perforation locator from the proppant-laden fracturing fluid to ensure that proppant does not impair a functionality of the perforation locator.

| Part No. | Part Description |
|---|---|
| 10 | Perforation locator |
| 10a | Perforation locator - alternate embodiment |

-continued

| Part No. | Part Description |
|---|---|
| 10b | Energizer sub |
| 12 | Cylindrical body |
| 12b | Energizer sub cylindrical body |
| 14 | First connector end |
| 14a | First connector end - alternate embodiment |
| 14b | Energizer sub first connector end |
| 16 | Second connector end |
| 16a | Energizer sub second connector end |
| 17 | Central passage |
| 17a | Central passage -alternate embodiment |
| 17b | Energizer sub central passage |
| 18 | Radial bores |
| 19 | Piston bores |
| 20 | Piston assemblies |
| 21 | Energizer sub fill plug |
| 22 | Perforation locator pins |
| 23 | Energizer sub piston |
| 24 | Radial bore female thread |
| 25 | Energizer sub fill bore |
| 26 | Piston retainer cap |
| 27 | Piston retainer cap central passage |
| 28 | Piston retainer cap male thread |
| 30 | Locator pin piston |
| 31 | Energizer fluid |
| 32 | High-pressure fluid seal |
| 33 | Energizer sub piston seals |
| 34 | Piston flange |
| 35 | Energizer sub piston stop |
| 36 | Poston pin |
| 38 | Piston pin bore |
| 40 | Piston pin insert |
| 42 | Piston return spring |
| 43 | Perforation locator end cap |
| 44 | Travel limit bushing |
| 45 | Well casing |
| 46 | Casing perforation |
| 47 | Work string |
| 48 | String weight indicator |
| 49 | Straddle packer |
| 50 | Collar locator |
| 51 | Casing perforator |

FIG. 1A is a perspective view of an embodiment of a perforation locator 10 in accordance with the invention in a condition for running into or out of a perforated well bore (hereinafter a "run-in condition"). The perforation locator 10 has a cylindrical body 12 with a first connector end 14 and a second connector end 16. In this embodiment, the first connector end 14 and the second connector end 16 are male connectors. However, it should be understood that either one or both of the first connector end 14 and the second connector end 16 may be female connectors. The cylindrical body 12 has a central passage 17 that extends from the first connector end 14 to the second connector end 16. A plurality of spaced-apart radial bores 18 in a periphery of the cylindrical body 12 receive piston assemblies 20, which will be described below in detail with reference to FIG. 3B. Each piston assembly 20 includes a perforation locator pin 22. In the run-in condition the respective locator pins 22 are in a retracted condition in which a top end of the respective locator pins 22 is flush with, or below, an outer periphery of the cylindrical body 12.

Figure 1B:
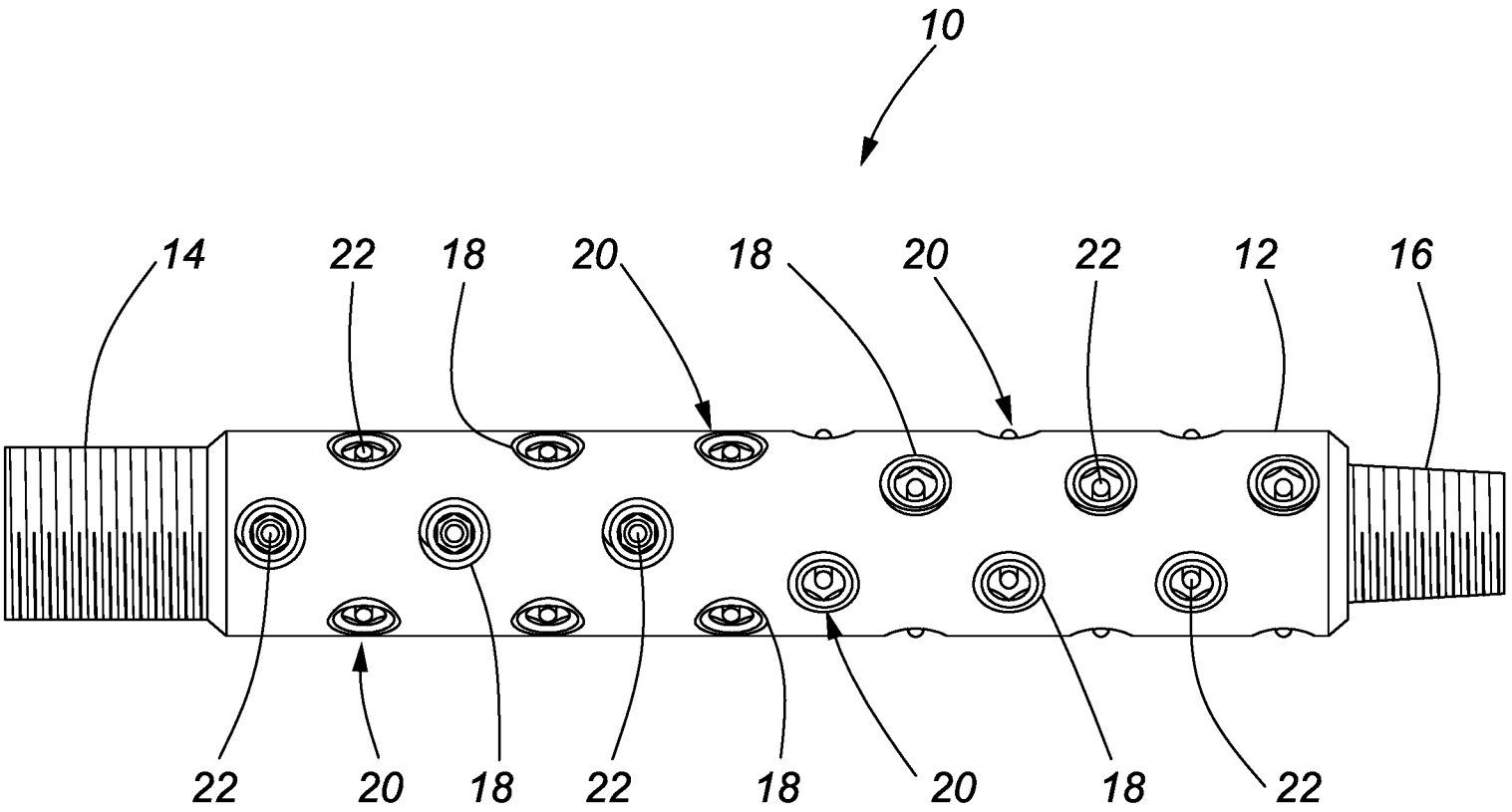
FIG. 1B is a side elevational view of the embodiment of the perforation locator shown in FIG. 1A.

FIG. 1B is a side elevational view of the embodiment of the perforation locator 10 shown in FIG. 1A.

Figure 2A:
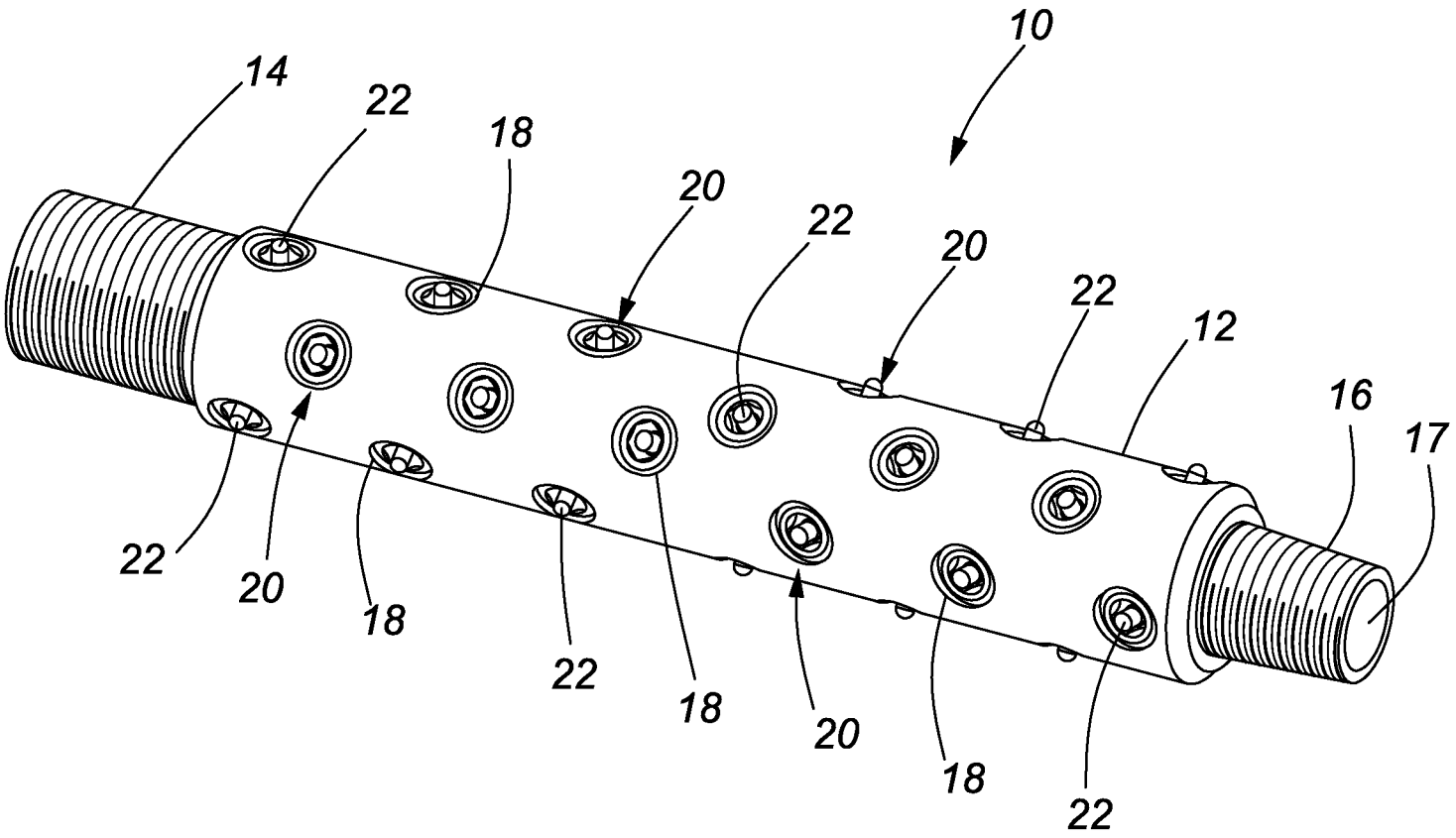
FIG. 2A is a perspective view of the embodiment of the perforation locator shown in FIG. 1A, in a perforation location condition used to locate perforation clusters a cased well bore.

FIG. 2A is a perspective view of the embodiment of the perforation locator 10 shown in FIG. 1A, in an energized condition for locating perforation clusters (hereinafter "locator condition") in a perforated well bore, as will be explained below with reference to FIG. 4A. In the locator condition, fluid pressure in the central passage 17 energizes the perforation locator 10 and urges the respective locator pins 22 of the piston assemblies 20 outwardly into contact with an inner surface of a well casing, as will be explained in detail below with reference to FIG. 4A.

Figure 2B:
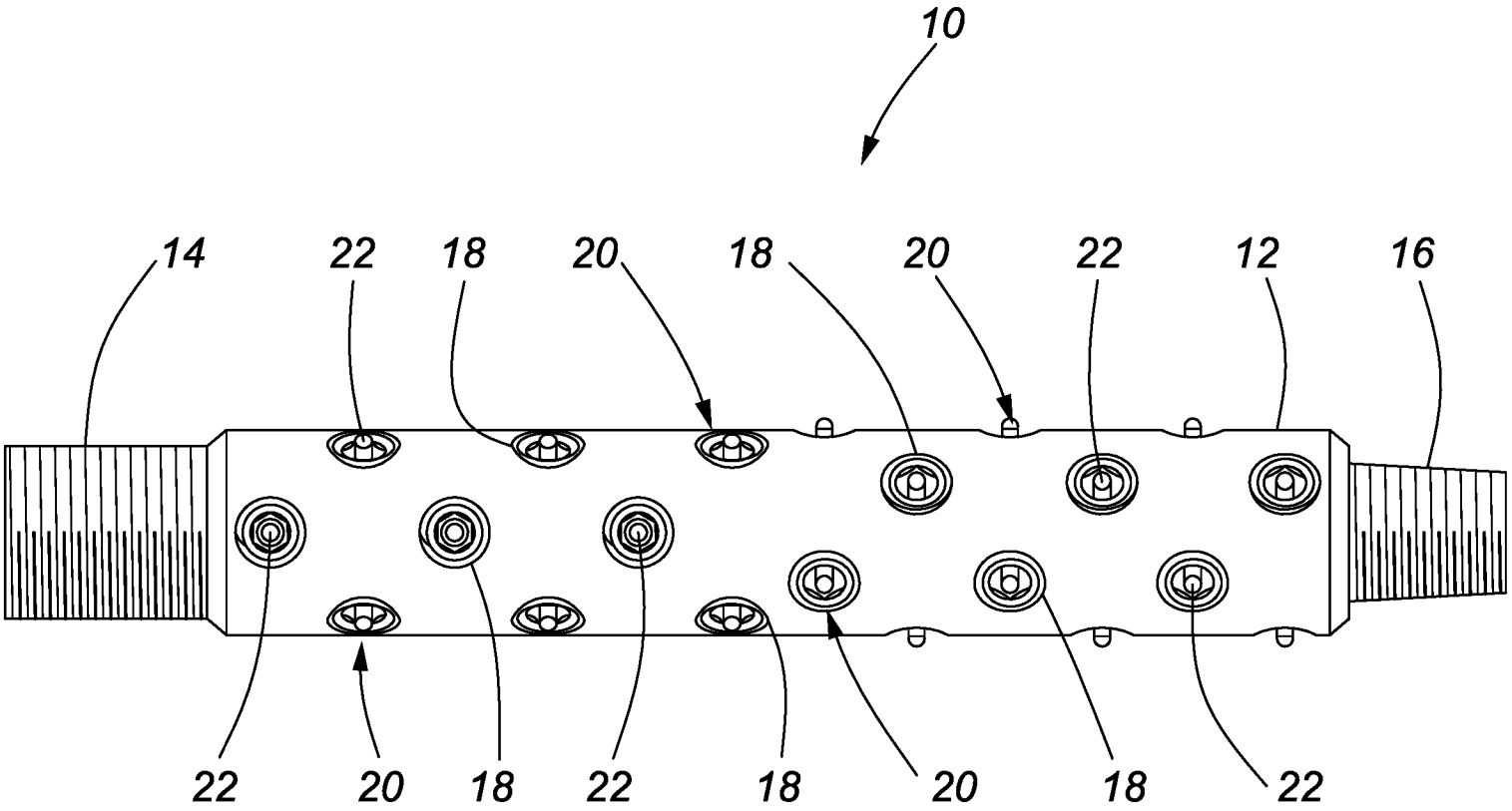
FIG. 2B is a side elevational view of the embodiment of the perforation locator shown in FIG. 2A.

FIG. 2B is a side elevational view of the embodiment of the perforation locator 10 in the locator condition shown in FIG. 2A.

Figure 3B:
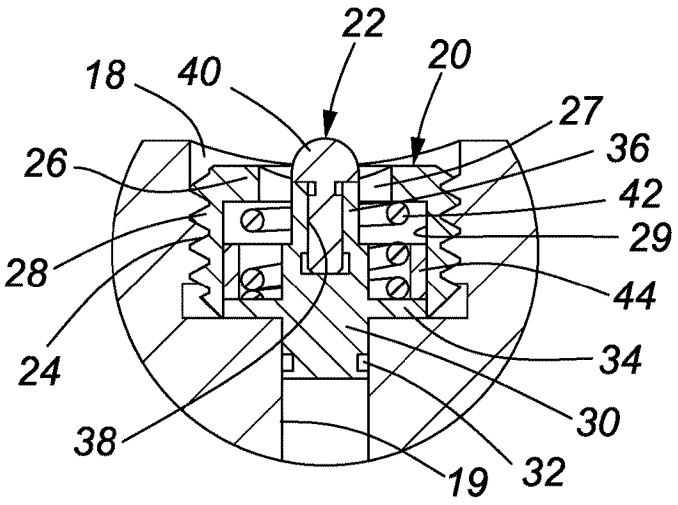
FIG. 3B is an enlarged cross-sectional view taken along lines 3A-3A of one piston assembly shown in FIG. 3A.
Figure 3:
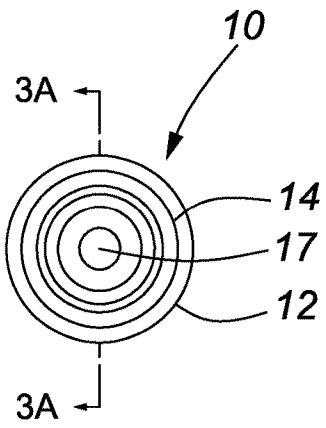
FIG. 3 is an end view of the embodiment of the perforation locator shown in FIG. 1A.

FIG. 3 is an end view of the embodiment of the perforation locator 10 shown in FIG. 1A.

Figure 3A:
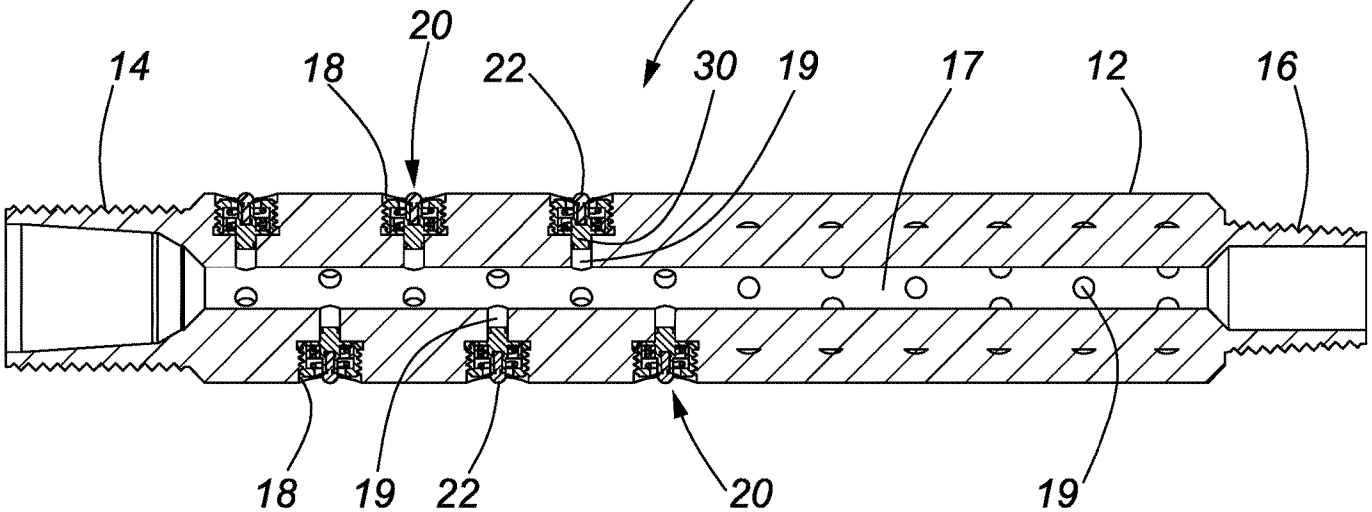
FIG. 3A is a cross-sectional view taken along lines 3A-3A shown in FIG. 3.

FIG. 3A is a cross-sectional view of the perforation locator 10, taken along lines 3A-3A shown in FIG. 3. As can be seen, each piston assembly 20 is retained in a respective threaded radial bore 18. A locator pin piston 30 of each piston assembly 20 is received in a piston bore 19. Each piston bore 19 is concentric with a one of the radial bores 18 and in fluid communication with the central passage 17, as will be explained below with reference to FIG. 3B in more detail.

FIG. 3B is an enlarged cross-sectional view taken along lines 3A-3A of FIG. 3 of one piston assembly 20 shown in FIG. 3A. The piston assembly 20 includes piston retainer cap 26 having a piston retainer cap central passage 27 through which the perforation locator pin 22 reciprocates from the run-in condition shown in FIG. 1A to the locator condition shown in FIG. 2A. A female thread 24 in the radial bore 18 engages a piston retainer cap male thread 28 to secure the piston, retainer cap 26 in the radial bore 18. The piston retainer cap 26 is hollow, having a cylindrical piston retainer cap chamber 29 that houses a piston return spring 42. The piston return spring 42 is a compression spring that constantly urges a piston flange 34 of the locator pin piston 30 against a bottom of the radial bore 18. A high-pressure seal 32 (for example, an O-ring) provides a high-pressure fluid seal between the piston bore 19 and the locator pin piston 30. A piston pin 36, integral with the locator pin piston 30 includes a piston pin bore 38 that receives a replaceable, wear-resistant piston pin insert 40. In one embodiment, the piston pin insert is a metal alloy, for example, carburized 8620 steel or flame-induction hardened ductile cast iron, though other wear-resistant metal alloys may also be used. As can be seen, a lower end of the piston return spring 42 is received within a travel limit bushing 44 which serves two functions. The travel limit bushing 44 prevents the perforation locator pins 22 from being forced too far into a casing perforation, which could lock the perforation locator 10 in a well bore if many perforation locator pins 22 were to simultaneously enter respective perforations in a perforation cluster, and/or damage the perforation locator pins 22. The travel bushing limiter 44 also limits the compression of the piston return spring 40, to inhibit any damage to the piston return spring 40.

Figure 4:
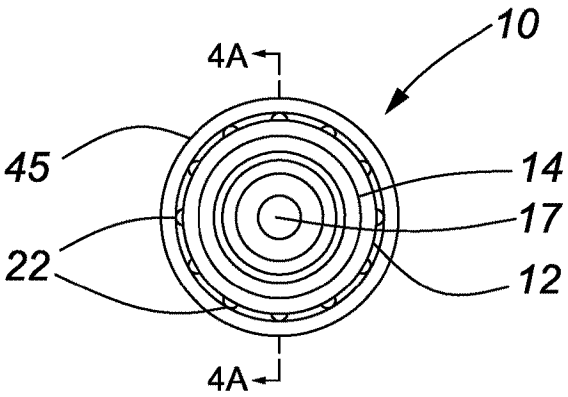
FIG. 4 is an end view of the embodiment of the perforation locator shown in FIG. 2A.

FIG. 4 is an end view of the embodiment of the perforation locator 10 shown in FIG. 2A in a well casing 45, with the perforation locator 10 in an energized locator condition. The locator condition is achieved by pumping fluid through a work string 47 (see FIGS. 7-11), as will be explained below in more detail with reference to FIGS. 4C and 6C.

Figure 4A:
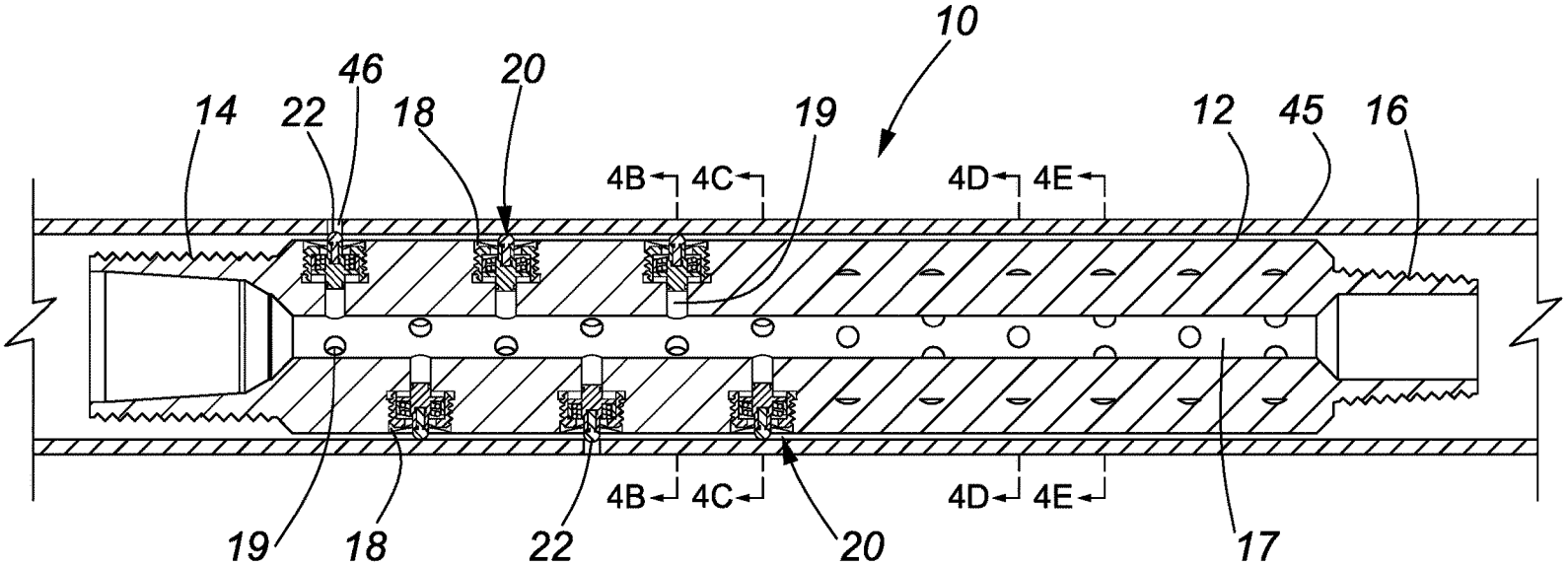
FIG. 4A is a cross-sectional view taken along lines 4A-4A shown in FIG. 4.

FIG. 4A is a cross-sectional view of the perforation locator 10 in the well casing 45, taken along lines 4A-4A shown in FIG. 4. As will be understood by those skilled in the art, the work string and other downhole tool components connected to the perforation locator 10 are not shown here for the sake of clarity. As can been seen, all of the perforation locator pins 44 are being urged against the well casing 45 by fluid pressure pumped into the central passage 17. As will be explained below with reference to FIGS. 11-13, this is generally performed during well completion, re-completion or workover to determine an exact location of a casing perforation cluster in real time. In one embodiment, about 200-500 psi of proppant-free fluid is pumped through the work string to energize perforation locator 10 to the locator condition. The fluid pressure is maintained in the work string and the central passage 17 while the perforation locator 10 is pulled (or pushed) through a casing joint of the well casing 45. The exemplary well casing 45 shown in FIG. 4A includes a perforation cluster (only two casing perforations 46 of the perforation cluster are visible in this view). Due to a radial distribution of the perforation locator pins 22, which will be described below with reference to FIGS. 4B-4E, there is a very high probability that at last one perforation locator pin 22 will be urged into at least one casing perforation in the perforation cluster, which may include 1 or more perforations, typically 4 or more perforations, as the perforation locator 10 is pulled (or pushed) through the well casing 45. As can be further seen, one of the perforation locator pins 22 has been urged into the casing perforation 46 of the well casing 45. As the perforation locator 45 is pulled (or pushed) through the well casing 45, a work string operator monitors a string weight indicator, as will be explained below with reference to FIG. 5. When one or more perforation locator pins 22 are urged into casing perforation(s), further movement of the work string is impeded by those perforation locator pin(s) 22. This resistance to work string movement registers at the surface on a work string weight indicator as an abrupt change in work string weight. These abrupt changes in work string weight indicated by the string weight indicator alerts the work string operator that the perforation locator 10 has encountered one or more perforations in a perforation cluster. The work string operator, knowing an exact relationship between the perforation locator and a desired tool in a tool string connected to the work string can then take appropriate action to position the desired tool with respect to the perforation cluster, as will be explained below with reference to FIGS. 11-13.

Figure 4B:
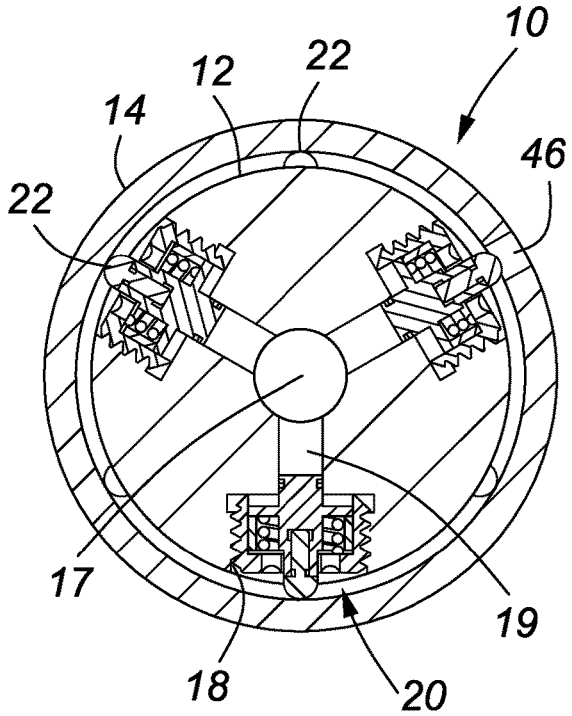
FIG. 4B is a cross-sectional view taken along lines 4B-4B of the perforation locator shown in FIG. 4A.

FIG. 4B is a cross-sectional view taken along lines 4B-4B of the perforation locator 10 shown in FIG. 4A. As can be seen in FIG. 4A, in one embodiment the piston assemblies 20 are arranged in groups of three axially-aligned piston assemblies 20 that are axially and radially spaced from each other group of axially aligned piston assemblies 20 in the perforation locator 10. It should be noted that the number of piston assemblies in a group of piston assemblies is a matter of design choice. As can be further seen in FIGS. 4A-4E, in this embodiment each piston assembly 20 is radially spaced 60 degrees from two other piston assemblies 20, making a total of 12 groups, of three piston assemblies 20, i.e. 36 piston assemblies 20 in this embodiment of the perforation locator 10. It should be understood that the total number of piston assemblies in the perforation locator 10 is a matter of design choice.

Figure 4C:
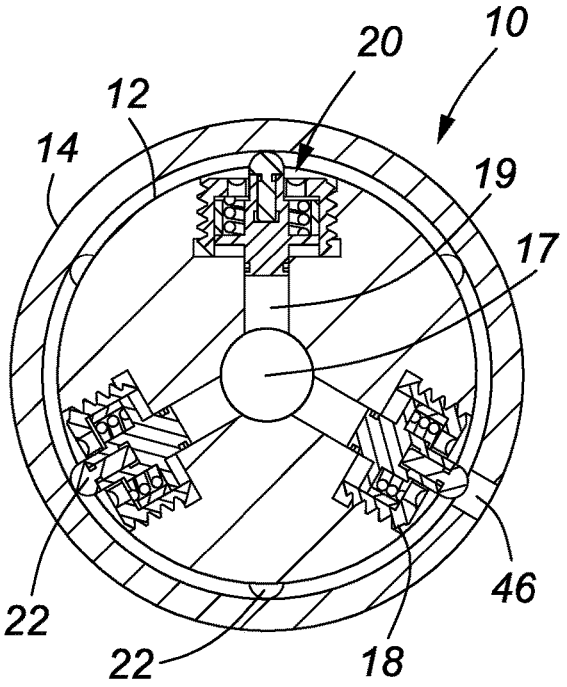
FIG. 4C is a cross-sectional view taken along lines 4C-4C of the perforation locator shown in FIG. 4A.

FIG. 4C is a cross-sectional view taken along lines 4C-4C of the perforation locator 10 shown in FIG. 4A.

Figure 4D:
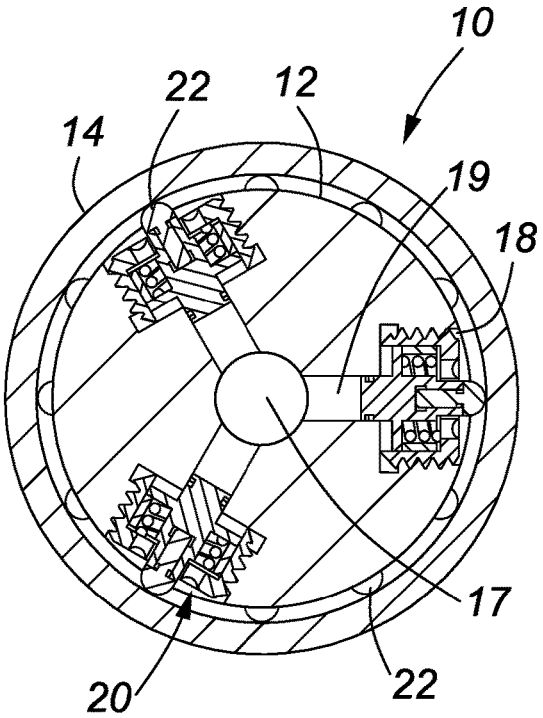
FIG. 4D is, a cross-sectional view taken along lines 4D-4D of the perforation locator shown in FIG. 4A.

FIG. 4D is a cross-sectional view taken along lines 4D-4D of the perforation locator 10 shown in FIG. 4A.

Figure 4E:
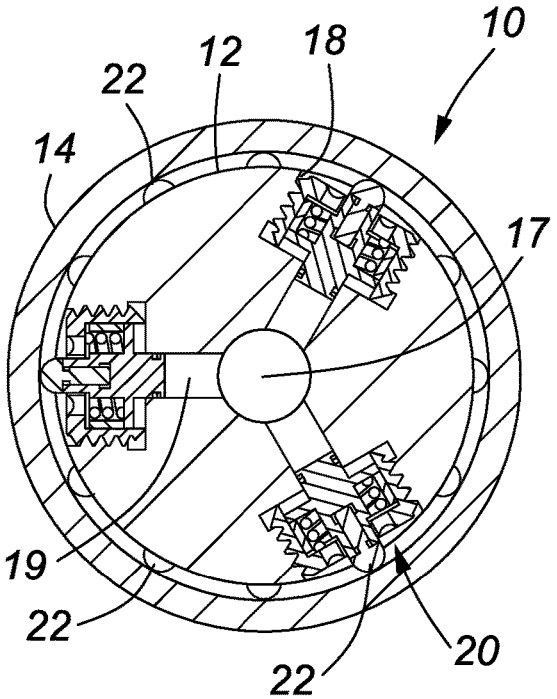
FIG. 4E is a cross-sectional view taken along lines 4E-4E of the perforation locator shown in FIG. 4A.

FIG. 4E is a cross-sectional view taken along lines 4E-4E of the perforation locator 10 shown in FIG. 4A. As is apparent, the piston assemblies 20 in each axially aligned group are offset 60° from the proceeding group, yielding a distribution of 3 axially aligned piston assembles 20 spaced at 30° intervals around a periphery of the perforation locator 10. Experience has shown that is distribution is adequate to reliably locate perforation clusters in a cased well bore.

Figure 5:
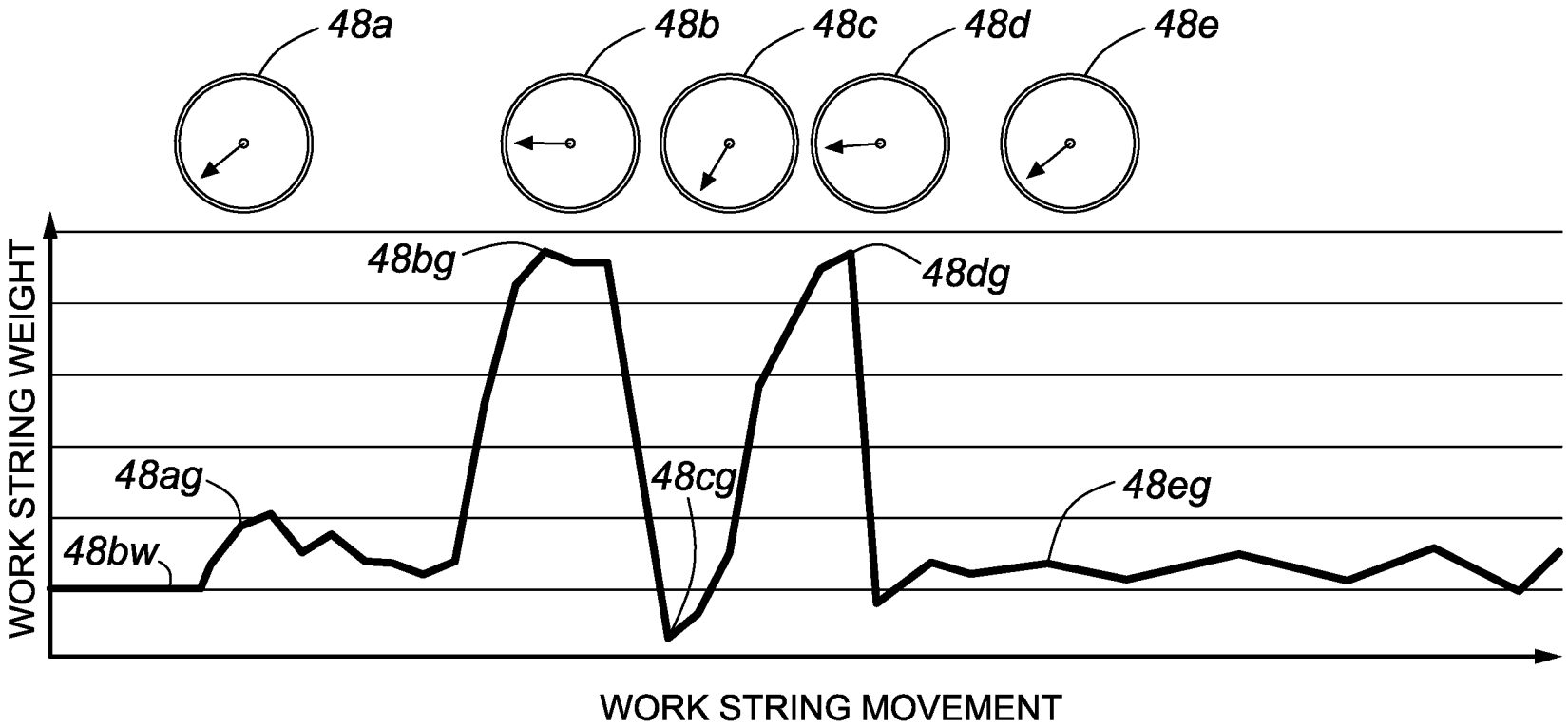
FIG. 5 is a schematic and graphical representation of changes to an indication of work string weight by a string weight indicator when a perforation cluster is located in a cased well bore using the perforation locator in accordance with the invention.

FIG. 5 is a schematic and graphical representation of changes to an indication of work string weight by a string weight indicator 48 when a perforation cluster is located in a cased well bore 45 using the perforation locator 10 in accordance with the invention. As well understood in the art, a work string operator has a string weight indicator 48 that gives a dynamic real-time indication of a weight of a work string suspended in a cased well bore. As understood by those skilled in the art, the string weight of a work string, especially a work string run into a horizontal well bore, is dependent on many factors that are not necessarily related to an actual total weight of the work string. Nonetheless, the string weight indicator can be used in conjunction with the perforation locator 10 to indicate that a perforation cluster has been located in the case well bore. As will be further understood by those skilled in the art, the string weight indicator 48 may be analog or digital and either indicator works equally well for the purposes of the invention. As shown in FIG. 5, after being run into a given position in a cased well bore, an operator's string weight indicator 48 will register a given base weight 48*bw* of the work string when the work string is at rest. When the operator begins to pull up on the work string an initial weight increase 48*ag*, indicated at 48*a* on the string weight indicator, will register as the inertia of the resting work string, is overcome. If the perforation locator pins 22 are urged into one or more perforations in the cased well bore, as described above with reference to FIG. 4A, resistance to further movement of the perforation locator 10 causes a characteristic increase 48*bg* in string weight that registers on the string weight indicator 48*b*. Movement of the work string quickly dislodges the perforation locator pins 22 and the resulting inertia temporarily drops the string weight 48*cg* below base weight 48*bw*, as shown at 48*c* on the string weight indicator. In this example the perforation cluster includes more perforation(s) and the string weight 48*dg* increases rapidly again as indicated at 48*d* on the string weight indicator. After the perforation locator pins 22 are pulled out of those perforation(s) the string, weight returns to near the base line and the operator, having noted the work string tally at the location of the perforations, and knowing an exact relationship between the location of the perforation locator 10 and the straddle packer 49, can push the work string back to straddle the perforation(s) and stimulate or re-stimulate them, as described below with reference to FIGS. 11 and 14. Alternatively, the operator may use a location of the perforations to locate new perforations in a well bore, as will be explained below with reference to FIG. 13.

Figure 6A:
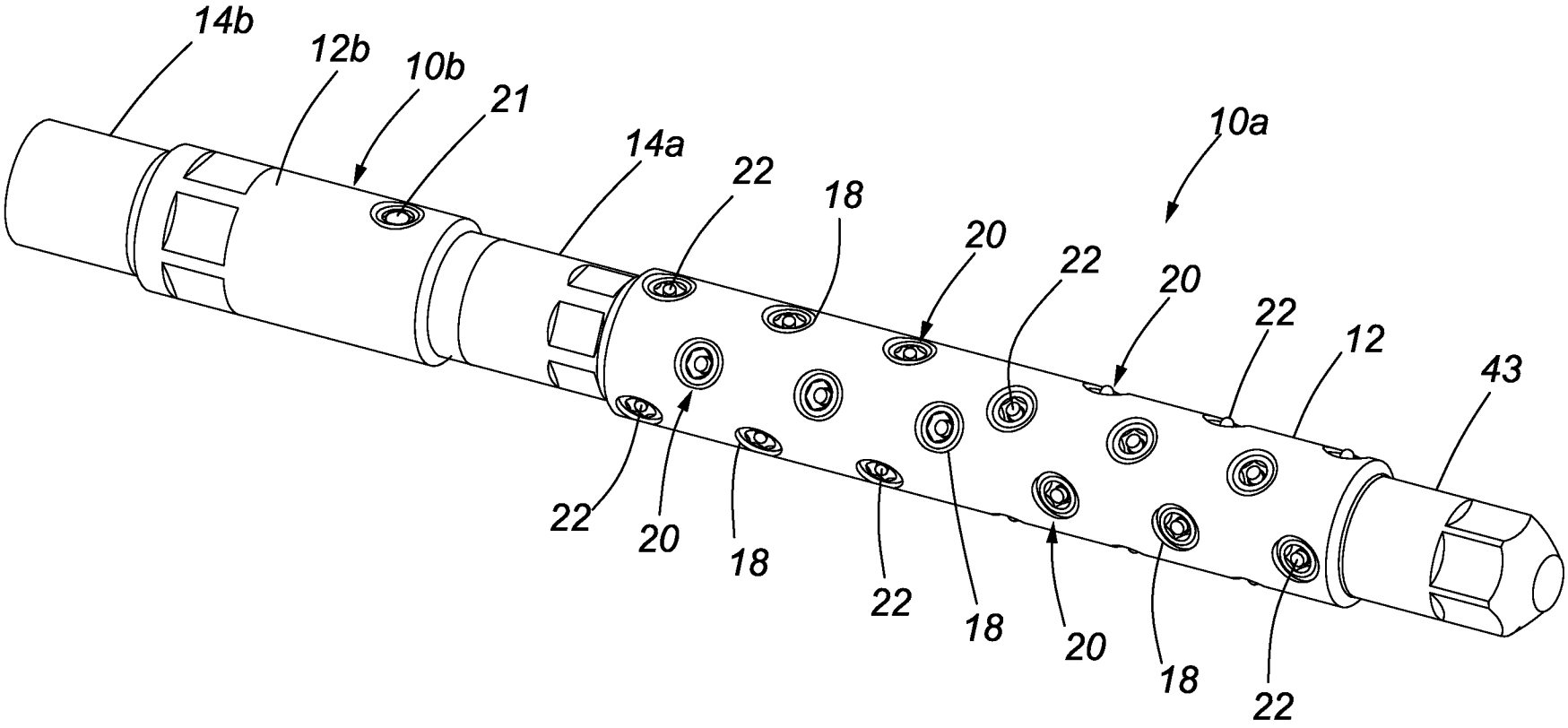
FIG. 6A is a perspective view of an embodiment of the mechanical perforation locator with an energizer sub for use with proppant-laden fracturing fluids, in a condition for running into a perforated well bore.

FIG. 6A is a perspective view of an embodiment of the mechanical perforation locator 10*a* with an energizer sub 10*b* designed to be used when proppant-laden fracturing fluids are employed to workover, re-complete or complete a cased well bore. The perforation locator 10*a* is shown in a run-in condition for running into a cased well bore. The perforation locator 10*a* is similar to the perforation locator 10 described above. However, the first connector end 14*a* is a female connector, a perforation locator end cap 43 is connected to the second connector end 16 (see FIG. 6A), and a central passage 17*a* is reduced in diameter for reasons that will be explained below with reference to FIG. 6B. The energizer sub 10*b* has an energizer sub cylindrical body 12*b* with an energizer sub first connector end 14*b*. The energizer sub first connector end 14*b* is a female connector end in this embodiment, but it may optionally be a male connector end. The energizer sub cylindrical body 12*b* has a threaded radial bore that receives an energizer sub fill plug 21, the function of which will be explained below with reference to FIG. 6B.

Figure 6B:
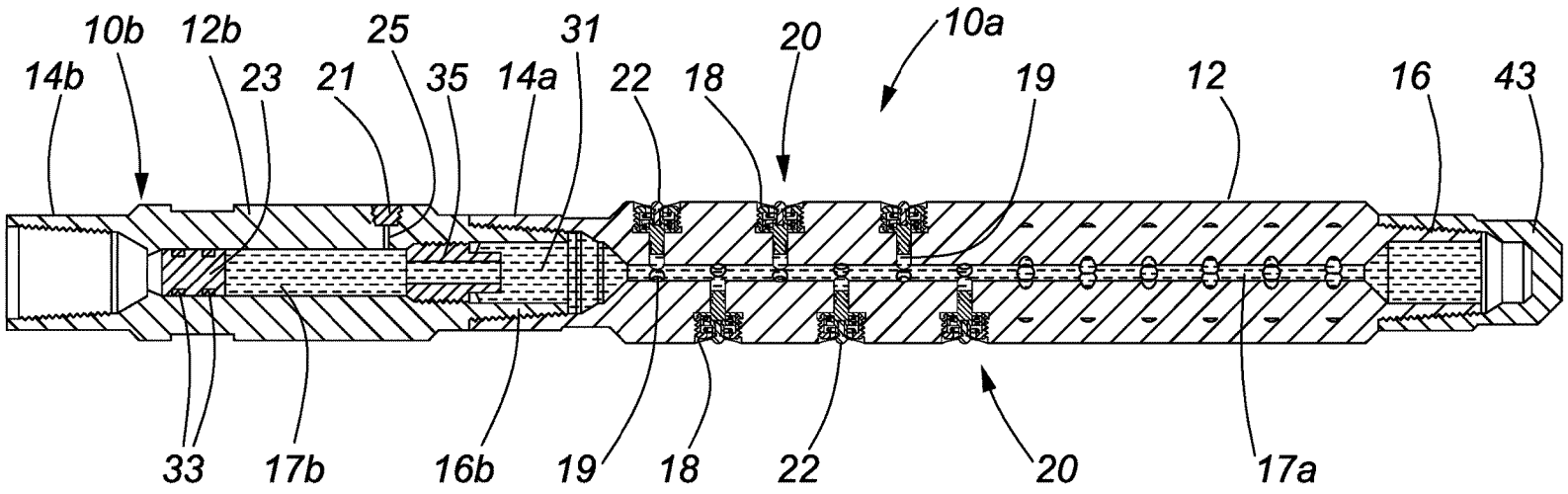
FIG. 6B is a cross-sectional view of the mechanical perforation locator shown in FIG. 6A.

FIG. 6B is a cross-sectional view of the mechanical perforation locator 10*a* and the energizer sub 10*b* shown in FIG. 6A. The energizer sub fill plug 21 seals an energizer sub fill bore 25. The energizer sub fill bore 25 provides fluid communication through the energizer sub cylindrical body 12*b*, and is used to inject an energizer fluid 31 into an energizer sub central passage 17*b* and a central passage 17*a* of the perforation locator 10*a*. The energizer sub 17*b* is in fluid communication with the central passage 17*a* of the perforation locator 10*a*. The energizer fluid 31 may be any stable, non-compressible, corrosion-inhibiting fluid, such as a hydraulic fluid. An energizer sub piston 23 reciprocates within the energizing sub central passage 17*b*, as will be explained below with reference to FIG. 68. An energizer sub piston stop 35 blocks a lower end of the energizer sub central passage 17*b* to contain the energizer sub piston 23 within the energizer sub central passage 17*b*. High-pressure energizer sub piston seals 33 inhibit a migration of energizer sub fluid 31 around the energizer sub piston 23.

Figure 6C:
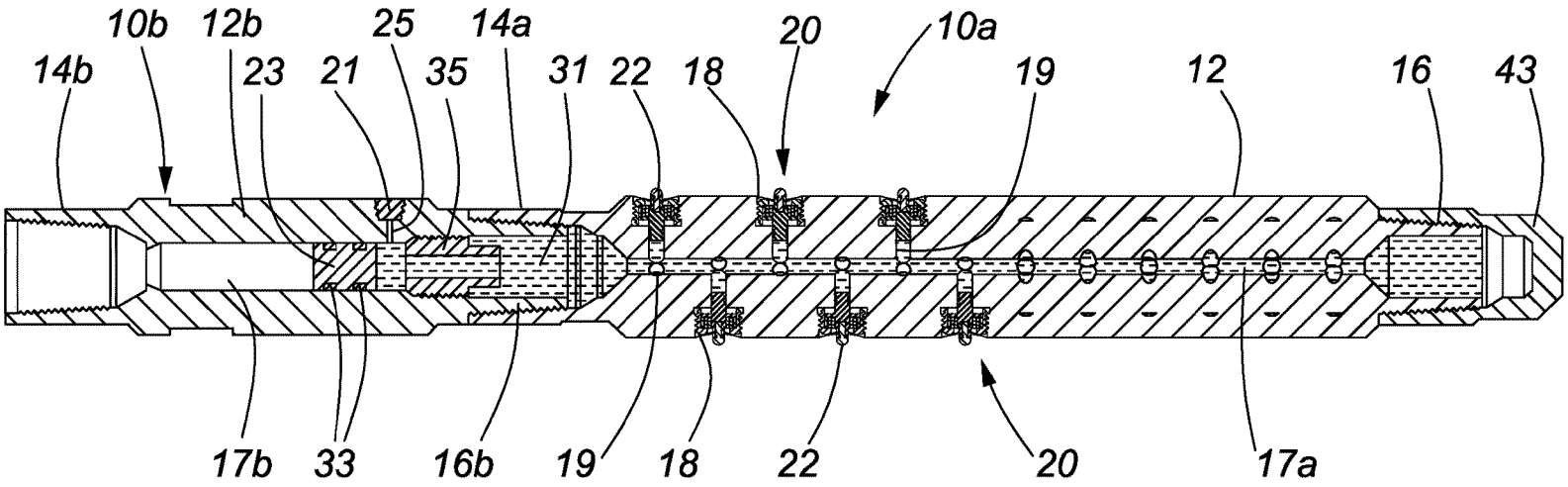
FIG. 6C is a cross-sectional view of the mechanical perforation locator shown in FIG. 6A in the perforation location condition used to locate perforations in a cased well bore.

FIG. 6C is a cross-sectional view of the mechanical perforation locator 10 and the energizer sub 10*b* shown in FIG. 6A in the perforation locator condition used to locate perforations in a cased well bore. As explained above, the perforation locators 10, 10*a* are shifted to the perforation locator condition by pumping fluid down a work string 47 until a fluid pressure of 200-500 psi is achieved in the work string 47. The fluid pressure in the work string 47 urges the energizer sub piston 23 down through the energizer sub central passage 17*b*, which pressurizes the energizer fluid 31 in the central passage 17*a* of the perforation locator 10*a*, and urges the respective locator pins 22 outwardly into the perforation locator condition. In this embodiment, the central passage 17*a* of the perforation locator 10*a* is of a smaller diameter than the central passage 17 of the perforation locator 10 described above. The smaller diameter of the central passage 17*a* reduces the amount of energizer fluid 31 required. When fluid pressure is released from the work string 47, the respective piston return springs 42 (see FIG. 3B) of the respective piston assemblies 20 urge the energizer fluid 31 out of the respective piston bores 19 and return the energizer sub piston 23 to the run-in condition shown in FIG. 6B.

Figure 7:
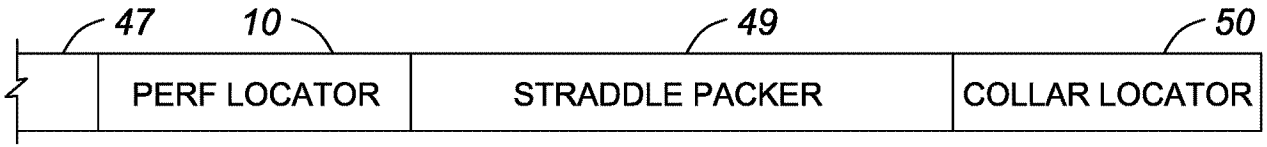
FIG. 7 is a schematic view of an exemplary tool string that includes the perforation locator for use in completing or reworking a cased well bore.

FIG. 7 is a schematic view of an exemplary tool string that includes the perforation locator 10 for use in completing or reworking a cased well bore. The tool string is connected to a work string 47, which may be a coil tubing string or a jointed tubing string, both which are well known in the art. In this embodiment, the tool string includes a straddle packer 49. The straddle packer 49 is, by way of example only, a straddle packer described in Applicant's co-pending U.S. patent application Ser. No. 16/197,573 entitled Cased Bore Straddle Packer filed Nov. 21, 2018, or Applicant's co-pending U.S. patent application Ser. No. 16/371,394 filed Jan. 4, 2019 and entitled Compression-Set Straddle Packer With Fluid Pressure-Boosted Packer Set, the respective specifications of which are incorporated herein by reference. The tool string further includes a collar locator 50, which may be an integrated component of the straddle packer 49.

Figure 8:
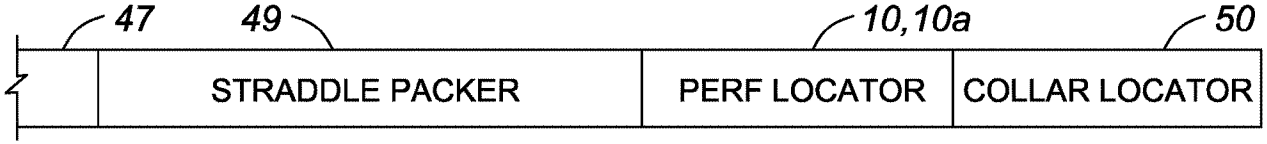
FIG. 8 is a schematic view of another exemplary tool string that includes the perforation locator for use in completing or reworking a cased well bore.

FIG. 8 is a schematic view of another exemplary tool string that includes the perforation locator 10 or 10*a* for use in completing or reworking a cased well bore connected to the work string 47. This tool string includes the same components except that the straddle packer 49 is connected to the work string 47, the perforation locator 10 or 10*a* is connected to the straddle packer 49 and the collar locator 50 is connected to a downhole end of the perforation locator 10 or 10*a*. If a collar locator 50 is connected to a lower end of the perforation locator 10*a*, the collar locator must provide a fluid-tight seal at the lower end of the central passage 17*a*.

Figure 9:
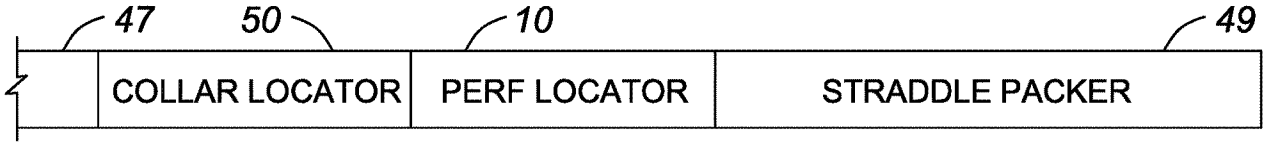
FIG. 9 is a schematic view of yet another exemplary tool string that includes the perforation locator for use in completing or reworking, a cased well bore.

FIG. 9 is a schematic view of yet another exemplary tool string that includes the perforation locator 10 for use in completing or reworking a cased well bore. In this embodiment, the collar locator 50 is connected to the work string 47, the perforation locator 10 is connected to a downhole end of the collar locator 50 and the straddle packer 49 is connected to a downhole end of the perforation locator 10.

Figure 10:
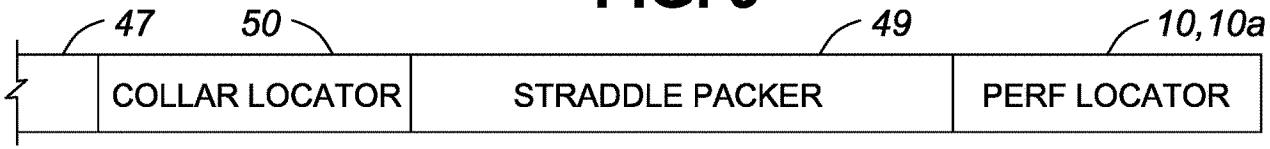
FIG. 10 is a schematic view of a further exemplary tool string that includes the perforation locator for use in completing or reworking a cased well bore.

FIG. 10 is a schematic view of a further exemplary tool string that includes the perforation locator 10 or 10*a* for use in completing or workover of a cased well bore. In this embodiment, the collar locator 50 is connected to the work string 47, the straddle packer 49 is connected to a downhole end of the collar locator 50 and the perforation locator 10 or 10*a* is connected to a downhole end of the straddle packer 49.

Figure 11:
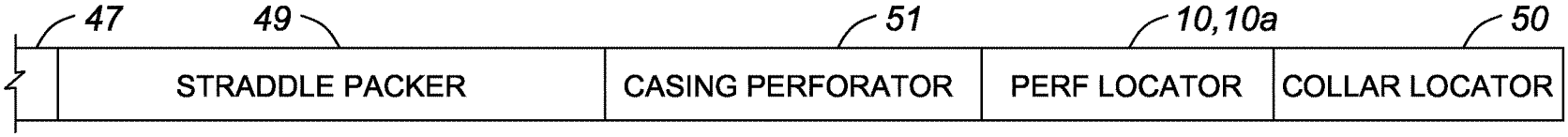
FIG. 11 is a schematic view of yet another exemplary tool string that includes the perforation locator for use in completing or re-completing a cased well bore.

FIG. 11 is a schematic view of yet another exemplary tool string that includes the perforation locator 10 or 10*a* for use in completing or re-completing a cased well bore. In this embodiment the straddle packer 49 is connected to the work string 47. A casing perforator 51, for example the casing perforator described in Applicant's co-pending U.S. patent application Ser. No. 16/155,057 filed on Sep. 10, 2018 and entitled Mechanical Perforator, the specification of which is incorporated herein by reference, is connected to a downhole end of the straddle packer 49. The perforation locator 10 or 10*a* is connected to a downhole end of the casing perforator 51, and the collar locator 50 is connected to a downhole end of the perforation locator 10 or 10*a*, as described above with reference to FIG. 8. This embodiment of a tool string is useful when new perforations are to be made in cased well bore during well re-completion, as will be explained below with reference to FIG. 13. It should be understood that the arrangements of tools shown in this tool string is exemplary only and the tools may be rearranged in a different order if desired.

Figure 12:
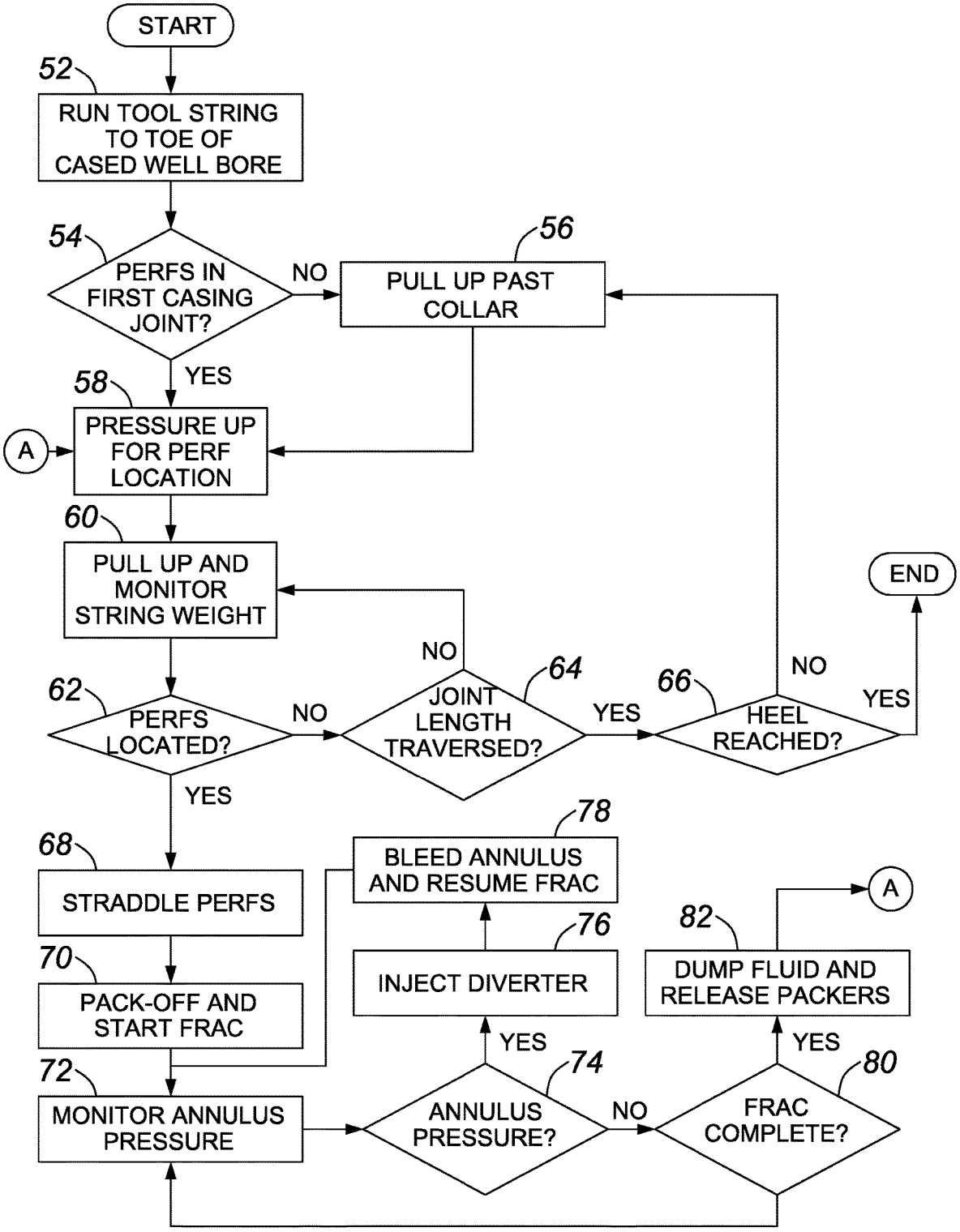
FIG. 12 is a flow chart illustrating a method of cased well bore workover using a perforation locator in accordance with the invention.

FIG. 12 is a flow chart illustrating a method of re-working a cased well bore using the perforation locators 10 or 10*a* in accordance with the invention. As used in this document well bore re-work, means re-stimulation of existing perforations in a cased well bore. In accordance with the invention, a tool string such as one of the tool strings shown in FIGS. 6-9 is run (52) to a toe of a cased well bore that is to be re-worked. A layout of perforations previously made in the cased well bore may or may not be, available. If the perforation layout is available, time may be saved by consulting it to determine approximately where the perforations were supposed to have been located in the well when it was completed. In any event, it is prudent to test the entire length of the casing for perforations, which is accomplished by pumping clean fluid at 200-500 psi into the tool string via the work string 47 to energize the perforation locator 10 and extend the perforation locator pins 22 to place, the perforation locator 10 in the locator condition. The tool string is then pulled through a first casing joint at the toe of the well and it is determined (54) is there are perforations in, the first casing joint. If not, the fluid pressure is released and the work string is pulled up hole past the first casing collar (54), which is detected using the collar locator 50 in a manner well understood in the art. The fluid pressure in the work string is again increased to the target of 200-500 psi (58) and the tool string is again pulled up while monitoring the work string operator's string weight indicator 48 (60). If no perforations are located (62) and the joint length has not been traversed (64) the monitoring continues (60) until the joint length is traversed. When the joint length is traversed (64), it is determined if the heel of the well has been reached (66). If so, the process ends. If not, the fluid pressure is released and the tool string is pulled up past the casing collar and the process continues (58). If perforations are located, as indicated by a characteristic spike in work string weight detected on the operator's work string weight indicator as explained above with reference to FIG. 5, the located perforations are straddled using the straddle packer 49, which is in a known relationship to the perforation locator. This permits the perforation cluster to be pressure isolated from the remainder of the cased well bore. The straddle packer 49 is then packed off and a re-stimulation of the existing, perforations is undertaken (70) using an appropriate fracturing fluid, which may include one or more proppants and/or other additives. While the re-stimulation is occurring, the annulus pressure is monitored at surface (72). If the straddle packer is correctly packed off, the only way fluid pressure can enter the annulus is through one or more uphole perforations. If annulus pressure is detected (74), frac fluid pumping is temporarily interrupted and an appropriate diverter system (76) is injected into the pressure isolated perforations. There are many known diverter systems, including particulate diverters (diverter beads or balls) and chemical diverters (time-limited coagulators, for example). After the diverter is injected, the annulus pressure is bled off and monitoring of the annulus pressure resumes (72). If annulus pressure is not detected (74) the frac treatment is continued until it is complete (80). Remaining fluid in the work string and tool string is then dumped, the packers of the straddle packer 49 are released and the process returns to step (58) until the heel of the well is reached and the entire well is re-worked.

Figure 13:
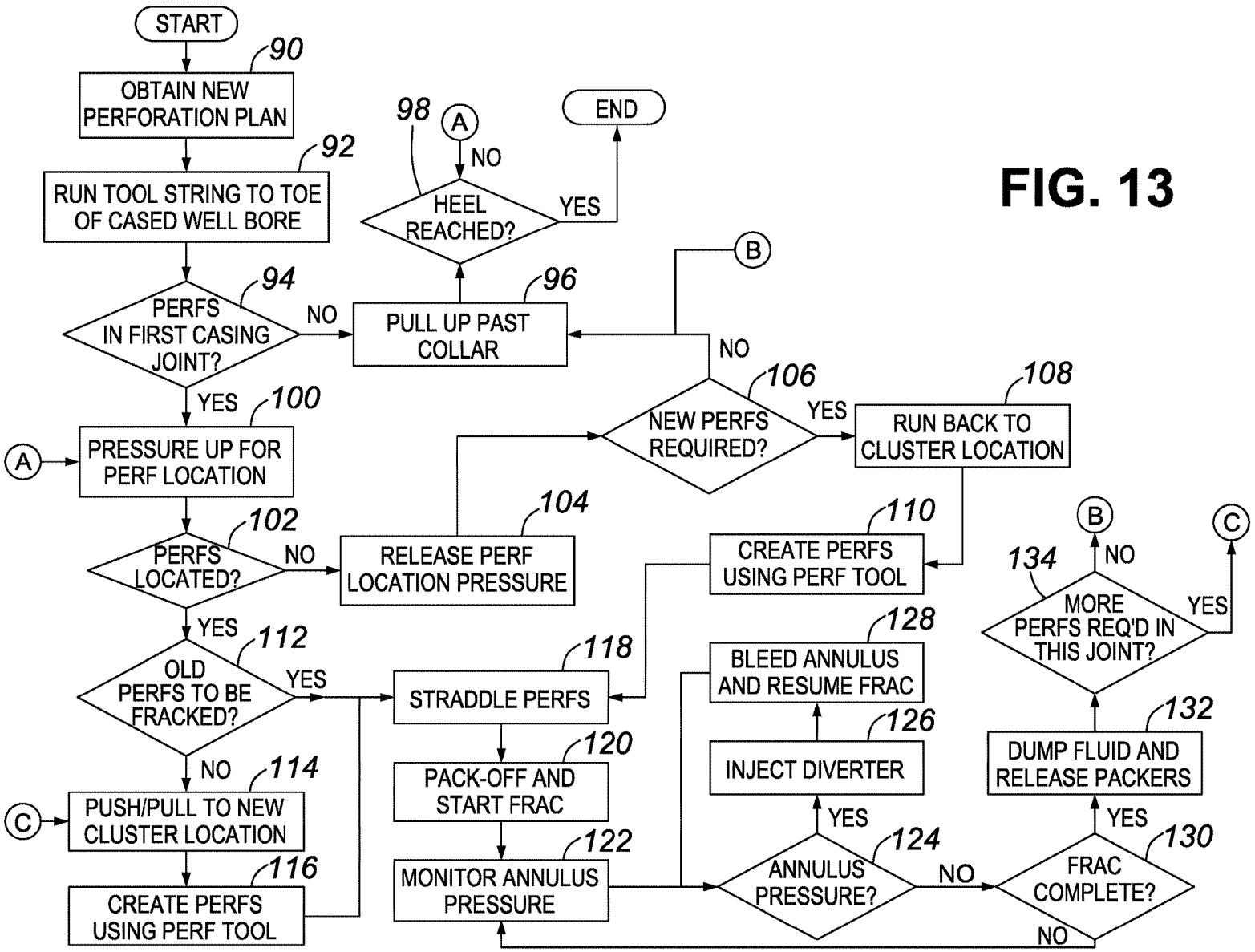
FIG. 13 is a flow chart illustrating a method of re-completing a cased well bore using a perforation locator in accordance with the invention.

FIG. 13 is a flow chart illustrating a method of re-completing a cased well bore using the perforation locators 10 or 10*a* in accordance with the invention. As used in this document, re-completing a cased well bore means adding new perforations to cased well bore. Existing perforations may or may not be re-stimulated. In any event, it is important to determine where the existing perforations are located so new perforations can be spaced from the existing perforations by a distance dictated by a well consultant or well manager in charge of the re-completion. Consequently, a new perforation plan for the cased well bore is obtained (90) and the tool string is run (92) to a toe of the cased well bore. If there are no perforations in the first casing joint (94), the tool string is pulled up past the first casing collar (96) and it is determined if the heel of the well has been reached (98). If new perforations are planned for the first casing joint (94) it is best to determine if perforations already exist in that casing joint, so fluid is pumped down the work string to energize the perforation locator 10 to locator condition (100) and the tool string is pulled up through the casing joint. If no perforations in the casing joint are located (102), fluid pressure is released from the perforation locator (104) and the new perforation plan is consulted to determine if new perforations are required (106). If so, the tool string is run back (108) to locate a casing perforator 51 where the new perforations are to be made and the new perforations are created (110) by operating the casing perforator 51. The new perforations are then straddled (118) by moving the work string to position the straddle packer 49 over the new perforations and the packers are packed-off (120). Fracturing of the new perforations is begun and fluid pressure in the annulus is monitored (122). If fluid pressure is detected in the annulus, an appropriate diverter system is injected (126), the fluid pressure in the annulus is bled off (128) and tracking resumes while monitoring the annulus pressure until the frac is complete (130). When fracking is complete, fluid is dumped from the tool string and the packers are released (132). It is then determined if more new perforations are required in that casing joint (134). If not, the tool string is pulled up past the casing collar (96), it is determined if the heel of the well has been reached (98) and if not, the process resumes at (100).

If perforations were located at (102), it is determined if the old perforations are to be re-stimulated (112). If not, the tool string 47 is pushed or pulled to locate the casing perforator 51 over a new perforation cluster location and the casing perforator 51 is operated to create the new perforations (116). A position of the tool string is then manipulated to maneuver the straddle packer over the new perforations (118), the packers are packed-off and a stimulation of a production zone behind the new perforations is begun (120). The annulus is then monitored for pressure (122) and a diverter system is employed if frac fluid migrates through the production zone to old perforations in the cased well bore, as described above with reference to steps (128)-(134).

Figure 14:
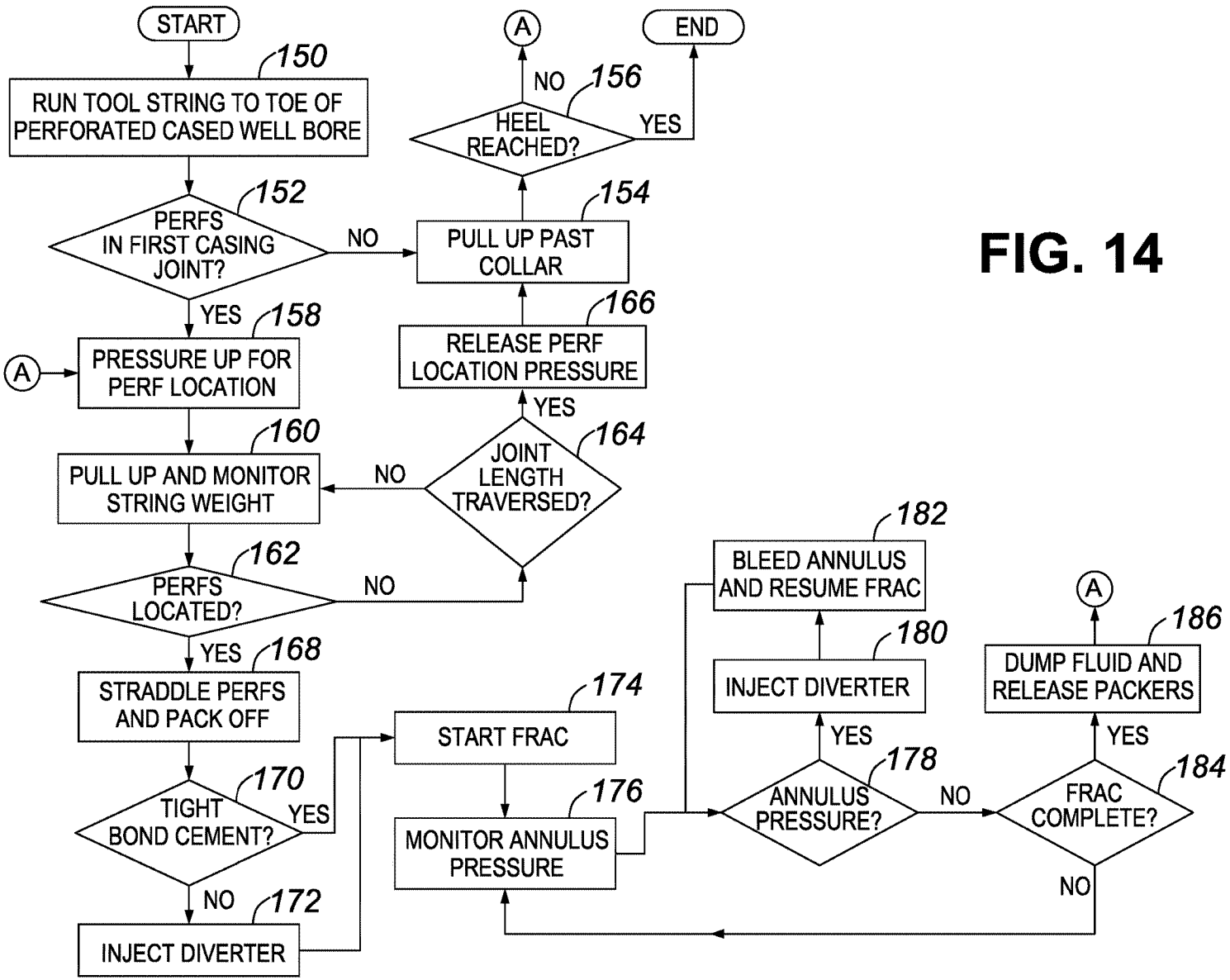
FIG. 14 is a flow chart illustrating a method of completing a cased well bore using a perforation locator in accordance with the invention.

FIG. 14 is a flow chart illustrating a method of completing a cased well bore using the perforation locators 10 or 10*a* in accordance with the invention. In accordance with this method, and entire cased lateral bore, or an entire section of a cased lateral bore to be put into production, is perforated using, for example, perforation gun strings run into the cased well bore using a wireline, or the like. No fracturing pumps are brought to the well site during this operation. Once the entire lateral bore, or designated section thereof, has been perforated, the fracturing pumps are moved onsite and a tool string including a straddle packer 49, the perforation locator 10, and a collar locator 50 is run into a toe of the cased well bore (150). In order to save time, the perforation plan may be consulted to determine if there are perforations in the first casing joint (152). If not, the tool string is pulled up past the collar and it is determined if the heel of the well bore (or end of the perforated section) has been reached (156). If not, fluid is pumped down the work string to energize the perforation locator 10 (158) and the tool string is pulled up while monitoring string weight (160). If perforations are located, the tool string is maneuvered to locate the straddle packer over the perforations and the packers are packed-off (168). If the casing has been installed with a "tight bond cement" (170), fluid migration behind the casing is improbable, and fracturing through the perforations is begun. If not, it is often practical to inject a diverter (172) prior to beginning the fracturing (174) to ensure that there is no migration of fracturing fluid behind the casing to uphole perforations in the cased well bore. Once the fracturing is begun, annulus pressure is monitored (176) to ensure the tight bond cement and/or the diverter system are functioning properly.

If annulus pressure is detected (178), an appropriate diverter is injected (180). Then the annulus pressure is bled off and fracturing resumes while the annulus pressure is monitored until the fracturing is complete (184). When the frac is complete, fluid is dumped from the tool string (186), the packers are released and the process resumes a (158).

If it is determined at (162) that no perforations were located in a casing joint (164), fluid pressure is released from the work string and the tool string is pulled up past the casing collar (154). It is then determined if the heel of the cased well bore (or the end of a section perforated for production) has been reached (156) and if not, the process continues at (158). Otherwise, all of the perforations in the cased well bore have been located and stimulated, and the process ends.

The explicit embodiments of the invention described above have been presented by way of example only. The scope of the invention is therefore intended to be limited solely by the scope of the appended claims.

We claim:

1. A perforation locator comprising a cylindrical body having a first connector end and a second connector end, a central passage that extends from the first connector end to the second connector end, and a plurality of piston assemblies having perforation locator pins that are movable, in response to fluid pressure in the central passage, from a run-in condition in which the perforation locator pins do not extend beyond a periphery of the cylindrical body to a perforation locator condition in which the perforation locator pins are extended beyond a periphery of the cylindrical body and urged to enter a perforation in a cased well bore when a one of the perforation locator pins passes over the perforation.

2. The perforation locator as claimed in claim 1 wherein the plurality of piston assemblies are received in a plurality of spaced-apart radial bores in a periphery of the cylindrical body, each radial bore receiving a piston assembly, and a piston bore concentric with each radial bore, each piston bore being in fluid communication with the central passage and accommodating a locator pin piston connected to the perforation locator pin of the piston assembly.

3. The perforation locator as claimed in claim 2 wherein the respective piston assemblies comprise a piston retainer cap threadedly secured in the respective radial bores, the piston retainer cap being hollow and having a piston retainer cap central passage through which the perforation locator pin reciprocates.

4. The perforation locator as claimed in claim 3 wherein the respective piston assemblies respectively comprise a compression spring received in the hollow piston retainer cap between a top wall of the piston retainer cap and a piston flange on the locator pin piston, the compression spring constantly urging the perforation locator pin to the run-in condition.

5. The perforation locator as claimed in claim 4 wherein the respective piston assemblies further comprise a travel limit bushing that surrounds an end of the compression spring and limits an extension of the perforation locator pins.

6. The perforation locator as claimed in claim 1 wherein the respective perforation locator pins comprise a piston pin having a piston pin bore that receives a piston pin insert.

7. The perforation locator as claimed in claim 1 further comprising an energizer sub connected to the first connector end, the energizer sub comprising an energizer sub piston that is urged by fluid pressure in a work string to generate the fluid pressure in the central passage.

8. The perforation locator as claimed in claim 7 wherein the energizer sub comprises, a cylindrical body having an energizer sub fill bore used to inject an energizer fluid into a central passage of the energizer sub and the central passage of the perforation locator.

9. A method of locating casing perforations in a cased well bore, comprising:

connecting a mechanical perforation locator to a work string and running the mechanical perforation locator into a cased well bore that contains at least one casing perforation cluster;

pumping pressurized fluid into the work string to energize the mechanical perforation locator and place it in a perforation locator condition; and moving the mechanical perforation locator in the perforation locator condition through the cased well bore until at least one perforation location pin of the mechanical perforation locator is urged into at least one perforation in the at least one perforation cluster and a work string weight indicator associated with the work string indicates a characteristic spike in a string weight of the work string, indicating a casing perforation has been located.

10. A method of performing a workover of a cased well bore, comprising:

connecting a tool string that includes a straddle packer, a collar locator and a mechanical perforation locator to a work string and running the tool string into a cased well bore that contains at least one casing perforation cluster;

pumping pressurized fluid into the work string to energize the mechanical perforation locator and place it in a perforation locator condition;

moving the mechanical perforation locator in the perforation locator condition through the cased well bore until at least one perforation location pin of the mechanical perforation locator is urged into at least one perforation in the at least one perforation cluster and a work string weight indicator associated with the work string indicates a characteristic spike in a string weight of the work string, indicating a casing perforation has been located;

releasing the pressurized fluid from the work string and relocating the tool string to straddle the located casing perforation with the straddle packer;

packing-off packers of the straddle packer to pressure isolate the casing perforation from the cased well bore; and pumping stimulation fluid down the work string to re-stimulate a production zone behind the pressure-isolated perforation.

11. The method as claimed in claim 10 further comprising monitoring the annulus of the cased well bore for fluid pressure while pumping stimulation fluid through the work string.

12. The method as claimed in claim 11 further comprising stopping the pumping of stimulation fluid if fluid pressure is detected in the annulus and injecting a diverter into the pressure-isolated perforation.

13. A method of re-completing a cased well bore, comprising:

connecting a tool string that includes a straddle packer, a collar locator, a mechanical perforation locator and a casing perforator to a work string and running the tool string into a cased well bore that contains at least one casing perforation cluster;

pumping pressurized fluid into the work string to energize the mechanical perforation locator and place it in a perforation locator condition;

moving the mechanical perforation locator in the perforation locator condition through the cased well bore until at least one perforation location pin of the mechanical perforation locator is urged into at least one perforation in the at least one perforation cluster and a work string weight indicator associated with the work string indicates a characteristic spike in a string weight of the work string, indicating a casing perforation has been located;

releasing the pressurized fluid from the work string and relocating the tool string so that the casing perforator is at a new location for a casing perforation cluster in the well bore located a prescribed distance from the located perforation;

operating the casing perforator to create the new casing perforation cluster;

relocating the tool string to straddle the newly created perforation cluster with the straddle packer;

packing-off packers of the straddle packer to pressure isolate the new casing perforation cluster from the cased well bore; and pumping stimulation fluid down the work string to stimulate a production zone behind the pressure-isolated new casing perforation cluster.

14. The method as claimed in claim 13 further comprising prior to relocating the casing string to create the new perforation cluster, manipulating the work string to straddle the located perforation and pumping stimulation fluid down the work string to re-stimulate the located perforation after packing-off the straddle packer.

15. The method as claimed in claim 13 further comprising monitoring the annulus of the cased well bore for fluid pressure while pumping stimulation fluid through the work string.

16. The method as claimed in claim 14 further comprising stopping the pumping of stimulation fluid if fluid pressure is detected in the annulus and injecting a diverter into the pressure-isolated perforation.

17. A method of completing a cased well bore, comprising:

perforating an entire length of the cased well bore to be put into production;

connecting a tool string that includes a straddle packer, a collar locator, and a mechanical perforation locator to a work string and running the tool string into the perforated cased well bore until a toe of the cased well bore is reached;

pumping pressurized fluid into the work string to energize the mechanical perforation locator and place it in a perforation locator condition;

pulling the mechanical perforation locator in the perforation locator condition up through the cased well bore until at least one perforation locator pin of the mechanical perforation locator is urged into at least one perforation in the at least one perforation cluster in the cased well bore, and a work string weight indicator associated with the work string indicates a characteristic spike in a string, weight of the work string, indicating a casing perforation has been located;

releasing the pressurized fluid from the work string and relocating the tool string so that the straddle packer straddles the located perforation;

packing-off packers of the straddle packer to pressure isolate the casing perforation from the cased well bore;

pumping stimulation fluid down the work string to stimulate a production zone behind the pressure-isolated casing, perforation; and repeating the steps of energizing the perforation locator, pulling the perforation locator, releasing fluid pressure in the perforation locator, packing-off the straddle packer packers and pumping stimulation fluid until all of the located perforations in the cased well bore have been stimulated.

18. The method as claimed in claim 17 further comprising pumping a diverter into the pressure-isolated perforation prior to pumping stimulation fluid into the pressure-isolated perforation.

19. The method as claimed in claim 17 further comprising monitoring the annulus of the cased well bore for fluid pressure while pumping stimulation fluid through the work string.

20. The method as claimed in claim 19 further comprising stopping the pumping of stimulation fluid if fluid pressure is detected in the annulus and injecting a diverter into the pressure-isolated perforation.

* * * * *